US009062690B2

(12) United States Patent
Gonzalez et al.

(10) Patent No.: US 9,062,690 B2
(45) Date of Patent: Jun. 23, 2015

(54) CARBON DIOXIDE COMPRESSION SYSTEMS

(75) Inventors: Miguel Angel Gonzalez, Bavaria (DE); Matthias Finkenrath, Bavaria (DE); Vittorio Michelassi, Florence (IT)

(73) Assignee: General Electric Company, Niskayuna, NY (US)

( * ) Notice: Subject to any disclaimer, the term of this patent is extended or adjusted under 35 U.S.C. 154(b) by 1161 days.

(21) Appl. No.: 12/956,153

(22) Filed: Nov. 30, 2010

(65) Prior Publication Data

US 2012/0131897 A1 May 31, 2012

(51) Int. Cl.

| | |
|---|---|
| ***F04F 5/18*** | (2006.01) |
| ***F04F 5/54*** | (2006.01) |
| ***F04B 15/00*** | (2006.01) |
| *F04D 17/12* | (2006.01) |
| *F04D 25/16* | (2006.01) |

(52) U.S. Cl.

CPC ... *F04F 5/54* (2013.01); *F04F 5/18* (2013.01); *F04B 15/00* (2013.01); *F04D 17/12* (2013.01); *F04D 25/16* (2013.01)

(58) Field of Classification Search

CPC ..... F04F 5/18; F04F 5/16; F04F 5/14; F04F 5/54; F04B 15/00; F04B 2015/0818; F04D 25/16; F04D 17/12

USPC ..... 417/77, 79, 87, 158, 173

See application file for complete search history.

(56) References Cited

U.S. PATENT DOCUMENTS

| | | | | |
|---|---|---|---|---|
| 1,964,060 | A | 6/1934 | Huet | |
| 5,598,721 | A | 2/1997 | Rockenfeller et al. | |
| 6,138,456 | A | 10/2000 | Garris | |
| 6,234,760 | B1 | 5/2001 | Popov et al. | |
| 2005/0176992 | A1 * | 8/2005 | Lin et al. | 562/412 |
| 2008/0155984 | A1 | 7/2008 | Liu et al. | |
| 2009/0218821 | A1 | 9/2009 | ElKady et al. | |
| 2010/0170265 | A1 | 7/2010 | Whaling et al. | |
| 2010/0180565 | A1 | 7/2010 | Draper | |

FOREIGN PATENT DOCUMENTS

| | | | | |
|---|---|---|---|---|
| CN | 101314102 | A | 12/2008 | |
| CN | 201575637 | U | 9/2010 | |
| WO | 2010037448 | A2 | 4/2010 | |
| WO | WO2010/037448 | * | 4/2010 | C01B 31/20 |

OTHER PUBLICATIONS

Copy of European Search Report and Written Opinion issued in connection with corresponding EP Application No. 11189945.6 on Aug. 21, 2014.

Unofficial English Translation of Chinese Office Action issued in connection with corresponding CN Application No. 201110405048.7 on Nov. 21, 2014.

* cited by examiner

*Primary Examiner* — Bryan Lettman

(74) *Attorney, Agent, or Firm* — Andrew J. Caruso

(57) ABSTRACT

A gas compression system for use with a gas stream. The gas compression system may include a number of compressors for compressing the gas stream, one or more ejectors for further compressing the gas stream, a condenser positioned downstream of the ejectors, and a waste heat source. A return portion of the gas stream may be in communication with the ejectors via the waste heat source.

13 Claims, 5 Drawing Sheets

CARBON DIOXIDE COMPRESSION SYSTEMS

TECHNICAL FIELD

The present application relates generally to gas turbine engines and more particularly relates to energy efficient carbon dioxide compression systems for use in natural gas fired gas turbine combined cycle power plants and other types of power generation equipment.

BACKGROUND OF THE INVENTION

Carbon dioxide ("$CO_2$") produced in power generation facilities and the like generally is considered to be greenhouse gas. Carbon dioxide emissions thus may be subject to increasingly strict governmental regulations. As such, the carbon dioxide produced in the overall power generation process preferably may be sequestered and/or recycled for other purposes as opposed to being emitted into the atmosphere or otherwise disposed.

Many new power generation facilities may be natural gas fired gas turbine combined cycle ("NGCC") power plants. Such NGCC power plants generally may emit lower quantities of carbon dioxide per megawatt hour as compared to coal fired power plants. This improvement in emissions generally may be due to a lower percentage of carbon in the fuel and also to higher efficiencies attainable in combined cycle power plants.

Moreover, NGCC power plants also may capture and store at least a portion of the carbon dioxide produced therein. Such capture and storage procedures, however, may involve parasitic power drains. For example, steam may be required to separate the carbon dioxide in an amine plant and the like while power may be required to compress the carbon dioxide for storage and other uses. As in any type of power generation facility, these parasitical power drains may reduce the net generation output. Plant efficiency thus may be lost in a NGCC power plant and the like with known carbon dioxide capture, compression, and storage systems and techniques.

There thus may be a desire for improved power generation systems and methods for driving carbon dioxide compression equipment and other types of power plant equipment with a reduced parasitic load. Such a reduced parasitic load also should increase the net power generation output of a NGCC power plant and the like with continued low carbon dioxide emissions.

SUMMARY OF THE INVENTION

The present application thus provides a gas compression system for use with a gas stream. The gas compression system may include a number of compressors for compressing the gas stream, one or more ejectors or further compressing the gas stream, a condenser positioned downstream of the ejectors, and a waste heat source. A return portion of the gas stream may be in communication with the ejectors via the waste heat source.

The present application further provides a compression system for compressing a flow of carbon dioxide. The compression system may include a number of compressors for compressing the flow of carbon dioxide, an ejector for further compressing the flow of carbon dioxide, a condenser positioned downstream of the ejector, and a waste heat source. A return portion of the flow of carbon dioxide is returned to the ejector via the waste heat source.

The present application further provides a gas compression system for use with a gas stream. The gas compression system may include a number of compressors for compressing the gas stream, a condenser positioned downstream of the compressors, a gas expander, a waste heat source for driving the gas expander, and wherein a portion of the gas stream downstream of the condenser is sent to the gas expander.

These and other features and improvements of the present application will become apparent to one of ordinary skill in the art upon review of the following detailed description when taken in conjunction with the several drawings and the appended claims.

DETAILED DESCRIPTION

Figure 1:
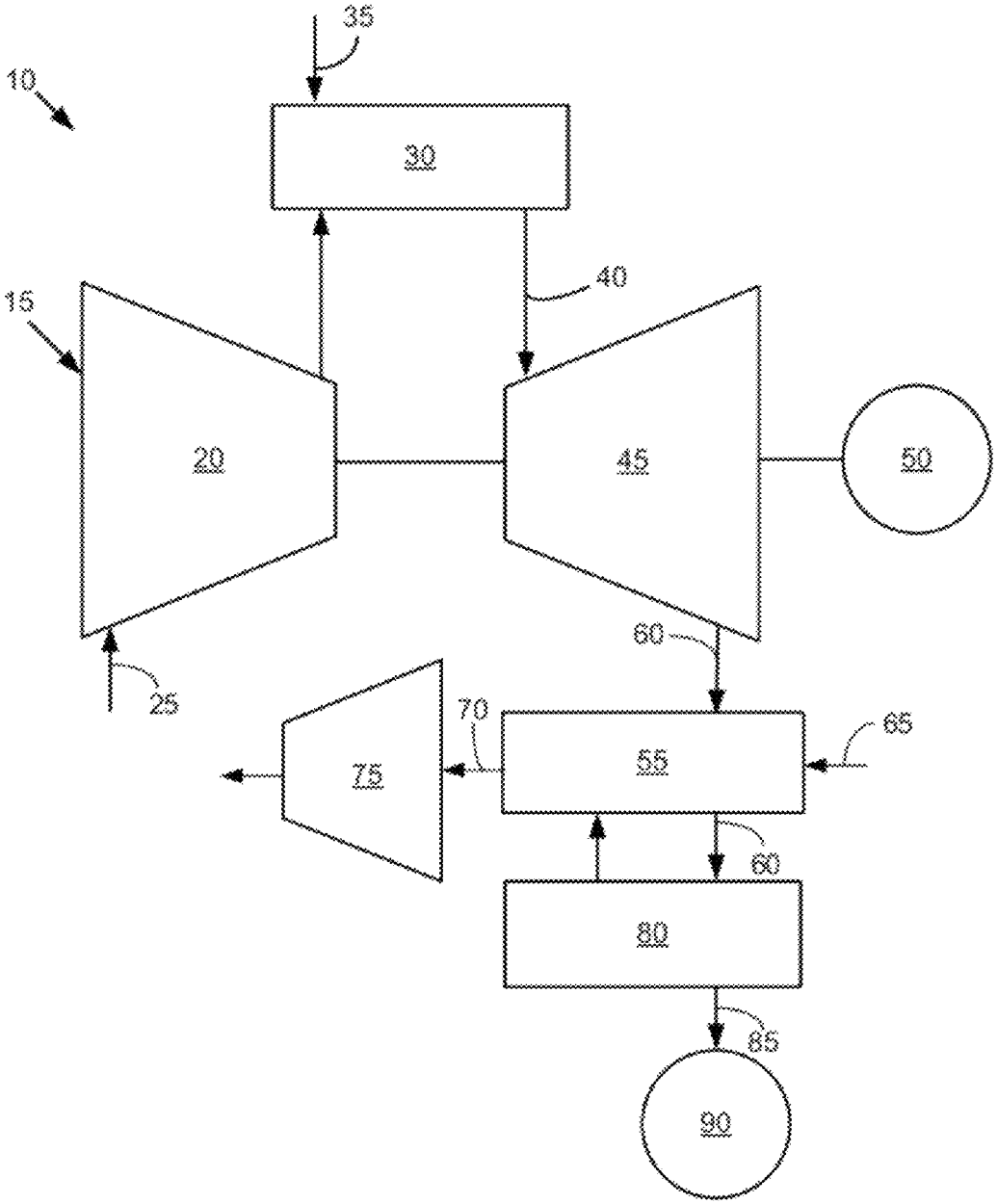
FIG. 1 is a schematic view of portions of a known natural gas fired gas turbine combined cycle power plant.

Referring now to the drawings, in which like numerals refer to like elements throughout the several views, FIG. 1 shows a schematic view of a known natural gas fired gas turbine combined cycle (NGCC) power plant 10. The NGCC power plant 10 may include a gas turbine engine 15. Generally described, the gas turbine engine 15 may include a compressor 20. The compressor 20 compresses an incoming flow of air 25. The compressor 20 delivers the compressed flow of air 25 to a combustor 30. The combustor 30 mixes the compressed flow of air 25 with a compressed flow of fuel 35 and ignites the mixture to create a flow of combustion gases 40. Although only a single combustor 30 is shown, the gas turbine engine 15 may include any number of combustors 30. The flow of combustion gases 40 is delivered in turn to a turbine 45. The flow of combustion gases 40 drives the turbine 45 so as to produce mechanical work. The mechanical work produced in the turbine 45 drives the compressor 20 and an external load 50 such as an electrical generator and the like.

The gas turbine engine 15 of the NGCC power plant 10 may use natural gas and/or other types of fuels such as a syngas and the like. The gas turbine engine 10 may have other configurations and may use other types of components. Other types of gas turbine engines and/or other types of power generation equipment also may be used herein.

The NGCC power plant 10 also may include a heat recovery steam generator 55. The heat recovery steam generator 55 may be in communication with a flow of now spent combustion gases 60. The NGCC power plant 10 also may include an additional burner (not shown) prior to the heat recovery steam generator 55 to provide supplementary heat. The heat recovery steam generator 55 may heat an incoming water stream 65 to produce a flow of steam 70. The flow of steam 70 may be used with a steam turbine 75 and/or other types of components. Other configurations also may be used herein.

The NGCC power plant 10 also may include a carbon dioxide separation and compression system 80. The NGCC power plant 10 also may include a flue gas fan (not shown) to pressurize slightly the flue gas and overcome the pressure losses herein. The carbon dioxide separation and compression system 80 may separate a flow of carbon dioxide 85 from the flow of spent combustion gases 60. The carbon dioxide separation and compression system 80 then may compress the flow of carbon dioxide 85 for recycling and/or sequestration in a carbon dioxide storage reservoir 90 and the like. The carbon dioxide 85 may be used for, by way of example only, enhanced oil recovery, various manufacturing processes, and the like. The carbon dioxide separation and compression system 80 may have other configurations and may use other components.

Figure 2:
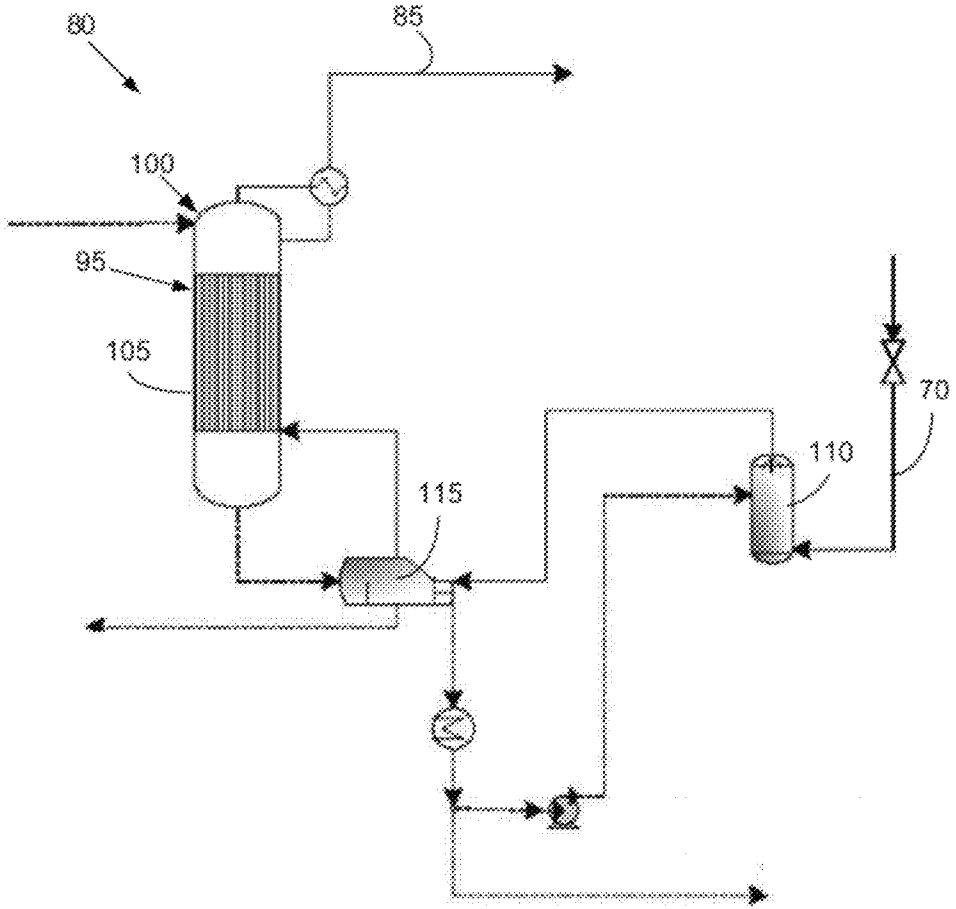
FIG. 2 is a schematic view of a known amine plant for use with the natural gas fired gas turbine combined cycle power plant of FIG. 1.
Figure 3:
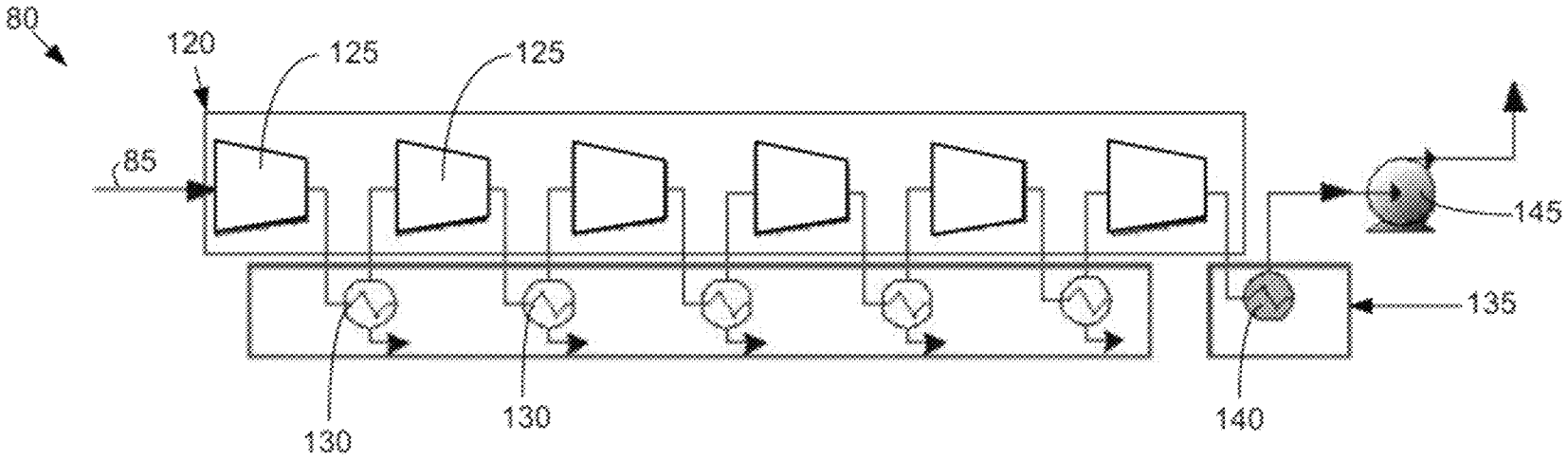
FIG. 3 is a schematic view of a known carbon dioxide compression system for use with the natural gas fired gas turbine combined cycle power plant of FIG. 1.

FIG. 2 shows a schematic view of several components of an example of the carbon dioxide separation and compression system 80. The carbon dioxide separation and compression system 80 may include an amine plant 95 as part of a separation system 100. Generally described, the amine plant 95 may include a stripper 105, an absorber (not shown), and other components. The stripper 105 may use alkanol amine solvents with the ability to absorb carbon dioxide at relatively low temperatures. The solvents used in this technique may include, for example, triethanolamine, monoethanolamine, diethanolamine, diisopropanolamine, diglycolamine, methyldiethanolamine, and the like. Other types of solvents may be used herein. The amine plant 95 strips the flow of carbon dioxide 85 from the flow of spent combustion gases 60.

The amine plant 95 may be fed from a steam extraction from the heat recovery steam generator 55, the steam turbine 75, or otherwise. The flow of steam 70, however, generally should be desuperheated and converted into a saturated steam in a desuperheater 110 and the like to avoid excessive heating of the amine flow therein. The desuperheater 110 may be in communication with the stripper 105 via a kettle or a reboiler 115. The flow of condensate exiting the reboiler 115 then may be sent to the desuperheater 110 or to the heat recovery steam generator 55. Other configurations and other types of components may be used herein.

The flow of carbon dioxide 85 then may be forwarded to a compression system 120 of the carbon dioxide separation and compression system 80. The compression system 120 may include a number of compressors 125 and a number of intercoolers 130. A number of vapor-liquid separators (not shown) also may be used herein. The compression system 120 also includes a carbon dioxide liquefaction system 135 so as to liquefy the flow of carbon dioxide 85. The carbon dioxide liquefaction system 135 may include a carbon dioxide condenser 140. A vapor-liquid separator also may be used. The compression system 120 also may include a pump 145 in communication with the carbon dioxide storage reservoir 90. Other types and configurations of the carbon dioxide storage and compression systems 80 may be known and may be used herein. Other configurations and other types of components also may be used herein.

Figure 4:
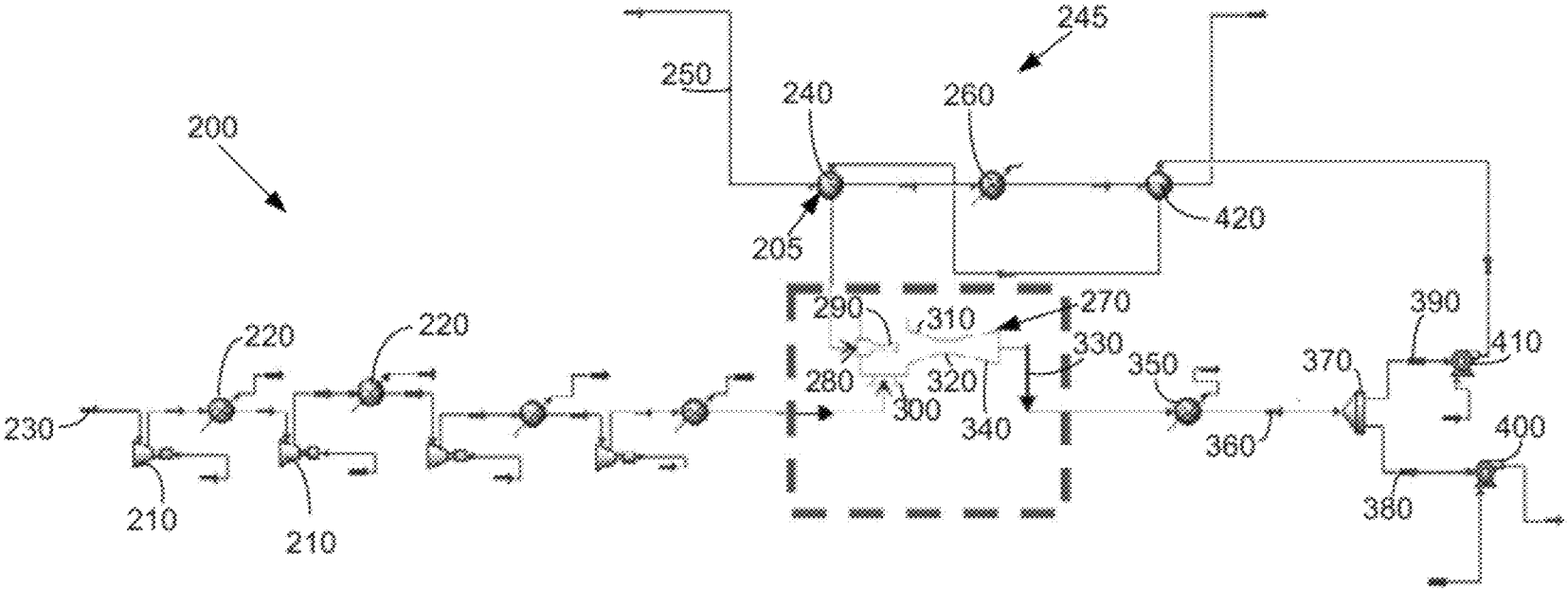
FIG. 4 is a schematic view of a carbon dioxide compression system as may be described herein.

FIG. 4 shows a carbon dioxide compression system 200 as may be described herein. The carbon dioxide compression system 200 also may use a number of compressors 210 and a number of intercoolers 220 in a manner similar to the compressors 125 and the intercoolers 130 of the compression system 120 described above. The compressors 210 and the intercoolers 220 may be of conventional design. Any number of the compressors 210 and the intercoolers 220 may be used. The compressors 220 may be in communication with a flow of gas such as a flow of carbon dioxide 230 from, for example, the carbon dioxide separation system 100 such as that described above or from other types of carbon dioxide sources.

The carbon dioxide compression system 200 also may be in communication with a waste heat source 205. In this example, the waste heat source 205 may be a desuperheater 240 of an amine plant 245 similar to that described above as well as a condensate cooler (described in more detail below) and the like. The flow of now superheated steam 250 may be from the heat recovery steam generator 55, the steam turbine 75, or any other heat source. The waste heat source 205 may be used then as a desuperheater and may create a flow of saturated steam in communication with a reboiler 260. Other configurations also may be used herein. The carbon dioxide compression system 200 thus uses the waste heat from desuperheating the flow of steam 250 before it enters the reboiler 260 or otherwise. Other sources of waste heat also may be used herein.

In the place of one or more of the compressors 125 of the compression system 120 described above, the carbon dioxide compression system 200 as described herein may include an ejector 270. Generally described, the ejector 270 is a mechanical device with no moving parts. The ejector 270 mixes two fluid streams based upon a momentum transfer. Specifically, the ejector 270 may include a motive inlet 280 in communication with a flow of heated carbon dioxide 390 from a return pump 410 (described in more detail below). The motive inlet 280 may lead to a primary nozzle 290 so as to lower the static pressure for the motive flow to a pressure below the suction pressure. The ejector 270 also includes a suction inlet 300. The suction inlet 300 may be in communication with the flow of carbon dioxide 230 from the upstream compressors 210. The suction inlet 300 may be in communication with a secondary nozzle 310. The secondary nozzle 310 may accelerate the secondary flow so as to drop its static pressure. The ejector 270 also may include a mixing tube 320 to mix the two flows so as to create a mixed flow 330. The ejector 270 also may include a diffuser 340 for decelerating the mixed flow 330 and regaining static pressure. Other configuration may be used herein and other types of ejectors 270 may be used herein. One or more ejectors may be used herein.

The carbon dioxide compression system 200 also may include a carbon dioxide condenser 350 downstream of the ejector 270. The carbon dioxide condenser 350 condenses the mixed flow 330 into a liquid flow 360 in a manner similar to that described above. A vapor-liquid separator also may be used. The compressors 210 and the ejector 270 need to compress the mixed flow 330 to a pressure sufficient for liquefaction in the condenser 350.

A flow separator 370 may be positioned downstream of the condenser 350. The liquid flow 360 may be separated into a storage flow 380 and a return flow 390. The storage flow 380 may be forwarded to a carbon dioxide storage reservoir 90 and the like via a storage pump 400. The return flow 390 may be pressurized via the return pump 410 and heated via the waste heat source 205 or other heat sources. The return flow 390 may be used as the motive flow in the ejector 270 or otherwise. The return flow 390 also may be heated in a condensate cooler 420 downstream of the reboiler 260 of the amine plant 245 or elsewhere. The condensate cooler 420 may be a conventional heat exchanger and the like. Other configurations may be used herein.

The carbon dioxide compression system 200 thus uses a number of the intercooled compressors 210, the ejector 270, and the waste heat source 205 so as to provide efficient carbon dioxide compression. Specifically, the last intercooled compressor 210 may be replaced by the ejector 270. The ejector 270 thus utilizes the low temperature waste heat from the desuperheater 240 or otherwise instead of other types of parasitic power. Because the last compression stage is normally the least efficient, replacing the last compressor 210 with the ejector 270 should improve the overall efficiency balance of the power plant.

The ejector 270 thus converts the pressure energy of the motive flow to entrain the suction flow via a Venturi effect. The mixed flow 330 leaving the ejector 270 then may be liquefied in the condenser 350. Part of the liquid flow 360 then may be stored while the return flow 390 may be heated via the condensate cooler 420 and returned to the ejector 270 as the motive flow so as to improve further overall compression efficiency.

The carbon dioxide compression system 200 thus uses two heat sources that currently are not exploited so as to improve overall efficiency. Specifically, the carbon dioxide compression system 200 includes the heat available in the desuperheater 240 so as to provide the motive flow. Further, the condensate exiting the reboiler 260 of the amine plant also may be used to reheat the return flow 390. Cooling the condensate, before it returns to the heat recovery steam generator 55 is advantageous in that it reduces the temperature of the flue gas leaving the heat recovery steam generator 55. As such, less power may be required to drive the flue gas fan. The parasitic power required for the later compression stages thus depends on only the return pump 410 so as to reduce overall power demands given the use of the waste heat source 205 and the flow of steam 250. Further, the number of overall moving parts is reduced through the use of the ejector 270 so as to reduce required maintenance and improve overall component lifetime.

Figure 5:
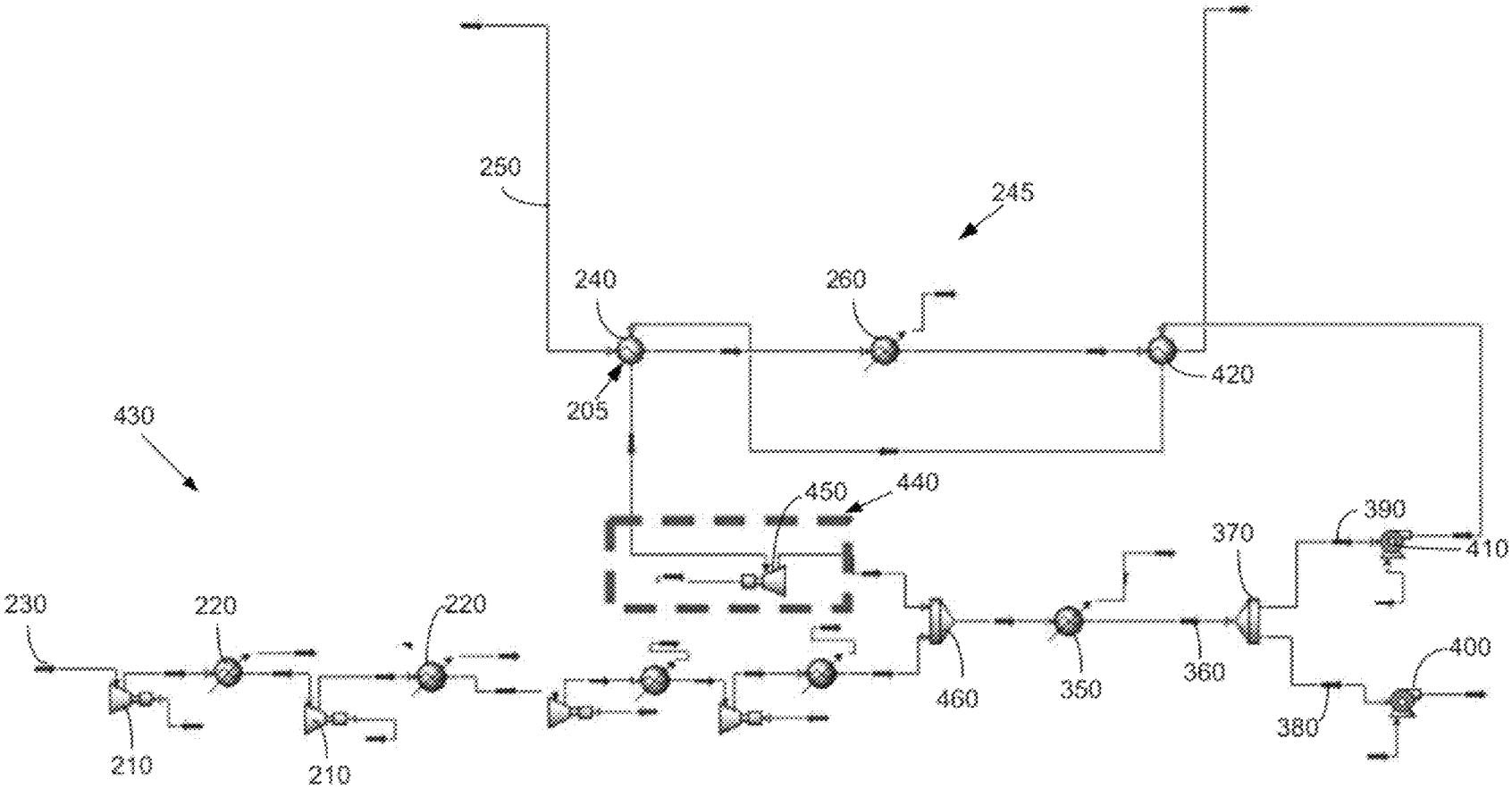
FIG. 5 is a schematic view of an alternative embodiment of a carbon dioxide compression system as may be described herein.

FIG. 5 shows an alternative embodiment of a carbon dioxide compressions system 430. In this example, the intercooled compressors 210 are in direct communication with the carbon dioxide condenser 350. Instead of the use of the ejector 270, a carbon dioxide expander 440 may be positioned downstream of the desuperheater 240 and the return flow 390. The carbon dioxide expander 440 may include a carbon dioxide turbine 450. The carbon dioxide expander 440 may be in communication with a flow joint 460 just upstream of the condenser 350. Other configurations may be used herein.

The intercooled compressors 210 thus pressurize the flow of carbon dioxide 230 while the condenser 350 creates the liquid flow 360 that is then further pressurized by the pumps 400, 410. The return flow 390 then may be reheated in the condensate cooler 420 and the desuperheater 240 and then expanded within the carbon dioxide turbine 450. The second embodiment of the carbon dioxide compression system 430 thus uses the flow of steam from the waste heat sources 205 described above so as to provide expansion of the return flow 390 to about the same pressure as the outlet of the compressors 210. The turbine 450 also may be mechanically coupled with one or more compressors 210. Other configurations may be used herein.

The first embodiment herein thus has the advantage that the ejector 270 has no moving parts. The second embodiment herein thus has the advantage that the carbon dioxide expander 440 has higher efficiency. Both embodiments are of equal significance and importance.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

We claim:

1. A gas compression system for use with a gas stream, comprising:

a plurality of compressors for compressing the gas stream;

one or more ejectors for further compressing the gas stream;

a condenser positioned downstream of the one or more ejectors; and a waste heat source;

wherein a return portion of the gas stream is in communication with the one or more ejectors via the waste heat source; and wherein the one or more ejectors each comprise a motive inlet in communication with the return portion of the gas stream and a suction inlet in communication with the gas stream, or in the alternative, wherein the one or more ejectors each comprise a primary nozzle in communication with the return portion of the gas stream and a secondary nozzle in communication with the gas stream.

2. The gas compression system of claim 1, wherein the waste heat source comprises a flow of steam from a desuperheater.

3. The gas compression system of claim 2, wherein the desuperheater comprises a portion of an amine plant.

4. The gas compression system of claim 1, further comprising a return pump downstream of the condenser for returning the return portion of the gas stream to the one or more ejectors.

5. The gas compression system of claim 4, further comprising a condensate cooler downstream of the return pump and in communication with the waste heat source.

6. The gas compression system of claim 1, further comprising a storage pump and a storage reservoir downstream of the condenser.

7. The gas compression system of claim 1, further comprising a flow separator downstream of the condenser.

8. A compression system for compressing a flow of carbon dioxide, comprising:

a plurality of compressors for compressing the flow of carbon dioxide;

an ejector for further compressing the flow of carbon dioxide;

a condenser positioned downstream of the ejector; and a waste heat source;

wherein a return portion of the flow of carbon dioxide is returned to the ejector via the waste heat source; and wherein the ejector comprises a motive inlet in communication with the return portion of the flow of carbon dioxide and a suction inlet in communication with the flow of carbon dioxide, or in the alternative, wherein the ejector comprises a primary nozzle in communication with the return portion of the flow of carbon dioxide and a secondary nozzle in communication with the flow of carbon dioxide.

9. The compression system of claim 8, wherein the waste heat source comprises a flow of steam from a desuperheater.

10. The compression system of claim 9, wherein the desuperheater comprises a portion of an amine plant.

11. The compression system of claim 8, further comprising a condensate cooler in communication with the return portion of the flow of carbon dioxide and the waste heat source.

12. The compression system of claim 8, further comprising a storage pump and a storage reservoir downstream of the condenser.

13. The compression system of claim 8, further comprising a flow separator downstream of the condenser.

* * * * *